United States Patent [19]

Schieber et al.

[11] Patent Number: 4,698,825

[45] **Date of Patent: * Oct. 6, 1987**

[54] PROTECTIVE COATING OF TEMPERATURE RESISTANT MATERIALS FOR THE METAL SHAFT OF COMBINATION ELECTRODES FOR THE ELECTRIC STEEL PRODUCTION

[75] Inventors: Franz Schieber, Röthenbach/Pegnitz; Dieter Zöllner, Schwaig/Nürnberg; Inge Lauterbach, Nürnberg; Konrad Koziol, Röthenbach/Pegnitz; Christine Zöllner, Schwaig/Pegnitz; Thomas Taube, Erlangen-Steudach, all of Fed. Rep. of Germany

[73] Assignee: Arc Technologies Systems Ltd., Georgetown, Ky.X

[ * ] Notice: The portion of the term of this patent subsequent to Aug. 13, 2002 has been disclaimed.

[21] Appl. No.: 757,697

[22] Filed: Jul. 22, 1985

Related U.S. Application Data

[63] Continuation of Ser. No. 486,560, Apr. 19, 1983, abandoned.

[30] Foreign Application Priority Data

Apr. 26, 1982 [CH] Switzerland ..... 2586/82

[51] Int. Cl.[4] ..... H05B 7/08

[52] U.S. Cl. ..... 373/93

[58] Field of Search ..... 373/93, 92, 91; 106/56

[56] References Cited

U.S. PATENT DOCUMENTS

| | | | |
|---|---|---|---|
| 1,483,507 | 2/1924 | Brockbank . | |
| 2,471,531 | 5/1949 | McIntyre et al. . | |
| 3,392,227 | 7/1968 | Ostberg . | |
| 3,409,451 | 11/1968 | Zeitsch | 106/56 |
| 4,145,564 | 3/1979 | Andrew et al. . | |
| 4,287,381 | 9/1981 | Montgomery et al. . | |
| 4,442,525 | 4/1984 | Zollner et al. | 373/93 |
| 4,468,783 | 8/1984 | Bauer et al. | 373/93 |

FOREIGN PATENT DOCUMENTS

| | | | |
|---|---|---|---|
| 2727314 | 8/1980 | Fed. Rep. of Germany . | |
| 1374458 | 11/1974 | United Kingdom . | |
| 1415305 | 11/1975 | United Kingdom . | |
| 1468880 | 3/1977 | United Kingdom . | |
| 57978 | 9/1940 | U.S.S.R. | 373/93 |
| 145948 | 5/1962 | U.S.S.R. . | |
| 834944 | 5/1981 | U.S.S.R. . | |
| 834146 | 5/1981 | U.S.S.R. . | |

*Primary Examiner*—Roy N. Envall, Jr.
*Attorney, Agent, or Firm*—Frost & Jacobs

[57] ABSTRACT

Temperature-resistant materials as protective coat for the metal shaft of combination electrodes for the electric steel production, constituting a compound material comprising a carbon share, which contains graphitic structural elements, and a share with at least one ceramic component. The protective elements, which are made of these materials, are characterized by long service times, little susceptibility to unwanted adhesive matter, and good emergency running properties.

7 Claims, 3 Drawing Figures

PROTECTIVE COATING OF TEMPERATURE RESISTANT MATERIALS FOR THE METAL SHAFT OF COMBINATION ELECTRODES FOR THE ELECTRIC STEEL PRODUCTION

This is a continuation of application Ser. No. 486,560, filed Apr. 19, 1983, now abandoned.

FIELD OF THE INVENTION

The invention relates to a protective coating of temperature resistant materials for the metal shaft of a combination electrode the electric steel production.

BACKGROUND OF THE INVENTION

Combination electrodes which are employed in electric arc furnaces for the electric steel production have been known for some time. They comprise an upper metallic section to which a lower section of consumable carbon material is attached by a threaded nipple or a similar means. The two sections may also be directly connected. On account of the high temperatures used, the possibility of arc migration, the existence of splashes of liquid metal and slag as well as other unfavourable influences, it has already been recommended to provide protective coats for the metal shaft. EP-A1 No. 00012573 (British Steel) describes a coat of fireproof material/slag that rests directly on the metal shaft.

GB-PS No. 1,223,162 (Oestberg) describes a cooling cycle made up of metal ducts which are embedded in ceramic material consisting e.g. of crystallized glass materials on a sillimanite basis or of refractory materials containing aluminium oxide. However, this solution is not applicable as far as the practical operation in the electric arc furnace is concerned. Here, the electrodes are frequently exposed to strong mechanical stresses due to vibrations, splashes of liquid metal, and electrode displacement or electrode handling, which will soon result in the damage of the ceramic part.

U.S. Pat. No. 4,145,564 (Andrew et al) describes the use of electrically conductive ceramic materials which rest on the metal shaft in the form of moldings. These ceramic moldings are put on metallic hook elements and are held by metallic spreaders. Specific examples of temperatureresistant ceramic materials are not given. Neither is this electrode suited for the long-term production of electric steel. Exploratory experiments with ceramic rings of refractory aluminates have shown that these protective ceramic elements, without being damaged, are covered with adhesive metal and slag particles which cannot be removed, so that it is no longer possible to extract the electrode throught the opening of the electric arc furnace lid. Lack of safety and high energy losses were the reasons why the extremely high temperatures observed during operation in the metal shaft could not be tolerated any more. BRIEF DESCRIPTION OF THE DRAWINGS FIG. 1 is a perspective view of a cover ring.

OBJECT OF THE INVENTION

Figure 1:
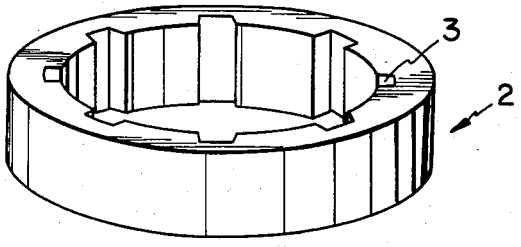

The object of the invention is to create protective coats for the metal shaft of combination electrodes. In addition to high service times, these protective coats are designed to guarantee a protection of the electrode that is sufficient for the practical operation of electric arc furnaces. They should also guarantee an economical operation of the electrode as far as energy is concerned, without impairing the mechanical handling of the electrode, including its insertion into and its extraction from the electric arc furnace.

This problem is solved by a protective coating of the above memtioned type, comprising a composit material of a carbon part with graphitic structural elements, and a part of at least one ceramic component.

In general, the compound material contains a carbon share in the amount of approx. 20–80 weight percent, while the ceramic component accounts for the remaining percentage. For the invention it is especially advantageous if the carbon material amounts to 35–60 weight percent, with the most favourable range lying between 40 and 55 weight percent.

Besides the carbon material and the ceramic component, the compound material may also contain binding agents, impregnating matter, and similar auxiliary agents, which, in general, account for approx. 15 weight percent of the total material. Although such additional binding agents, impregnating matter, etc. are not always required, it has frequently proved useful to include binding agents and impregnating matter in the amount of approx. 1–9 weight percent in relation to the total material, depending on the type of carbon component and the type of ceramic component selected. Binding and impregnating agents may help to obtain a denser, less porous, and more compact material of a single component, e.g. of carbon, or they facilitate a more favourable combination of carbon and ceramic components. Binding agents and impregnating substances are e.g. materials which have been traditionally used for the production of electrographites on the basis of premium cokes. They include pitches, tars, tar-pitches, phenolic resins, etc.

However, the compound material may also contain ceramic components which have binding qualities of their own, e.g. ductile, extremely fire-proof clays, etc. within the framework of the invention it is preferable that the carbon share of the compound material contain graphitic structural elements which, in general, account for 25–90 weight percent of the carbon share. Favourable results are usually obtained if the share of graphitic structural elements in the carbon component lies between 40 and 80 weight percent in a relation to the carbon component.

Depending on the requirements to which the electrode is exposed in thhe production of electric steel, within the framework of the invention there are different possibilities of selecting the carbon component. The graphitic structural elements may consist of natural graphite, electrographite or mixtures thereof. The non-graphitic share of the carbon component may be made up of anthracite, by-product coke, petroleum coke, tar-pitch coke, carbon black, etc. The carbon component may, therefore, be a mixture of graphite of varying origin and of anthracite, cokes of different specifications, etc.

If the production of electric steel involves extremely tough conditions, e.g. in the HP and UHP range, to which the electrode is exposed, it is preferable to have a carbon component that is entirely of graphite. The results obtained were especially favourable, when natural graphite was used for this purpose. When natural graphite is used, dark shale graphites with large scales are preferred.

When natural graphite is used, the qualities used should be free from low melting point impurities or from admixtures which, in the presence of oxygen, at high temperatures produce or release gaseous products, e.g. pyrite, carbonates which are decomposable at high temperatures, etc.

However, not all conditions require that the carbon component contains graphitic elements, which means that in individual cases the carbon material may be free from such elements. This is the case when the electrode is exposed to less rough conditions of the electric steel production. In general, longer life times, improved heat transfer values, and less adhesion of slag material are achieved, if the share of graphite in the compound material is higher. This may be influenced by the type of carbon component on the one hand, and its quantity on the other.

Within the framework of the invention it is preferable to provide protective coats which contain graphitic structural elements in the amount of 30–50 weight percent in relation to the total weight of the compound material. As mentioned earlier, depending on the operating conditions, the type of electrode used, etc. it is, however, possible to obtain satisfactory results, even if the graphite share in relation to the compound material is beyond the specified preferred range.

In relation to the total weight of the compound material, the ceramic component may amount to approx. 20–80 weight percent, with amounts in the range of 40 to 65 weight per cent yielding especially favourable results.

In general, the compound material contains the carbon component and the ceramic component in the form of particles, fibers, or layers in homogeneous or heterogeneous distribution. As a rule, this helps to obtain a ceramic "matrix", in which the carbon share is embedded and selectively distributed. Thus, the high temperature properties of both components complement each other in a favourable way, which results in surprisingly long service times. In individual cases it is, however, possible to aim at an inhomogeneity of the individual components within the compound material, although this is done for specific aplications only.

The compound material to be used in accordance with the invention may be produced in many different ways. As a rule, the usual methodologies for the production of compound materials are applicable, with due regard for the properties of refractory, i.e. ceramic, components and carbon components.

A typical procedure for the production of compound material is to mix the original particles, i.e. the carbon component as well as the ceramic component, if necessary by adding water and binding agents, then to mold them, and finally to burn them. It is frequently favourable to add water, as it facilitates kneading of the material until it is completely homogeneous.

In certain cases, depending on how and how much of the ceramic component is added, a period of maturation may follow. During this period the materials are left to themselves for some hours or for some weeks in an atmosphere of increased humidity, if necesssary.

Having been mixed and having "matured", the material is molded by pressing, tamping, or pouring. Within the framework of the invention it is preferable to provide a protective coat made up of moldings which may be put on the metal shaft of the combination electrode in a removable manner. Such molding are e.g. pipes, pipe sections, rings, and ring sectors. To obtain a specially favourable cover of the metal shaft, these individual moldings may be designed in a special way. With regard to the design of such removable moldings reference is made to P No. 31 02 776.8, (U.S. Pat. No. 4,442,525) the German patent application of the applicant, the contents of which shall herewith be considered part of this text.

The molding of such coats which are put on the metal shaft in a removable way may also be achieved by means of specific techniques which include vibration shaping and extrusion.

Within the framework of the invention it is preferable if the compound material contains the carbon particles in predominantly anisotropic alignment. A privileged orientation in longitudinal direction is obtained by application of the following procedures: extrusion, continuous vibration, isostatic pressing with movable shape, manual forming, and centrifugal casting. Such compound material which contains the carbon particles in predominantly longitudinal direction, is characterized by a high oxidation resistance, little susceptibility to adhesive slag, and good ablation properties, if it is aligned parallel to the axis of the electrode.

However, the compound material used in accordance with the invention may also contain the carbon particles in transverse direction, which is achieved by block pressing, tamping, injection moulding, cold and hot isopressing, vibration, pouring, and spraying. Especially favourable orientations, which result in an increased thermal conductivity of the molding, are obtained by hitting or vibration.

According to a preferred embodiment of the invention the compound material has a thermal conductivity of less than 210 kj/mhk.

In general, the compound material is burned at temperatures of up to 1600° C., preferably at temperatures between 1200° C. and 1400° C. If the burning and sintering temperatures exceed 500° C., the operator should see to it that no fresh air is supplied and that air circulation is avoided. In individual cases, burning may be conducted in several stages, so that a burning stage at a low temperature is followed by a burning stage at high temperatures. If compound materials of graphite and MgO are used, it is customary to have a preliminary burning stage in a temperature range between 900° C. and 1400° C., which, depending on the quantity of MgO, may be followed by renewed burning at a higher temperature. In general, it is desireable to start with a preliminary drying stage at a rather low temperature to extract any humidity left and then to increase the temperature only gradually over long periods until the burning temperature is reached.

The ceramic component contained in the compound materials used in accordance with the invention may be selected from a broad range of refractory compounds. Generally, these compounds are refractory oxides, carbides, nitrides as well as mixtures thereof. Combinations of oxides or silicates of Zr, Al or Mg or nitrides of Ti, Si, boron compound of Ti or Zr or carbides of Si, Zr or Ti are good examples. Fireclay, clay, kaolins, silicon dioxide, sillimanite, $Al_2O_3$, MgO, sintered dolomite, magnesiumchromium oxide ore, forsterite, silicon carbide, silicon nitride, zircon oxides, zircon mineral, titanium oxide, aluminium titanate containing silicate, spinels, and mixtures thereof have proved useful ceramic components of the compound material used in accordance with the invention. Preferable among them are refractory clays, MgO, silicon carbide, silicon nitrides, and aluminium titanates containing silicates.

It may be desirable that the ceramic and/or carbon component(s), at least partly, take(s) the form of fibers, e.g. kaolinite fiber, asbestos fiber, carbon fiber, etc. Boron oxides and/or refractory rare earth compounds may be added to the ceramic components mentioned above.

The combination of the ceramic and the carbon componet by type and quantity as well as their subsequent pressing and sintering is controlled by keeping the thermal expansion coefficient of the compound material below $15\times10^{-6}$/K. Compound materials which are preferred in accordance with the invention have a thermal expansion coefficient in the range of $(2\text{–}12)\cdot10^{-6}$/K. By complying with these values, the heat supplied to the protective elements as a result of the melting operations is dissipated via the cooling system of the electrode in such a way that the temperature of the protective coat can be kept at relatively low values, without having to maintain high liquid coolant pressures. As a consequence, the protective elements will have expecially long service times.

It may be useful to design the moldings in such a way that the temperature of the copper shaft, which is cooled at a water pressure of less than 8 bar, is kept below 300° C.

A special application of the materials used in accordance with the invention is to use them for the manufacture of moldings in the form of pipes, rings, segments, or sectors, which are put on the metal shaft of the electrode in a removable manner. According to a preferred embodiment of the invention the moldings rest on the electrode or are attached to it by covered screwed connections, threads, etc. In this context it is of special importance that at least the lower part of the metal shaft, which is inserted into the electric arc furnace, is completely covered with the materials used according to the invention. The exterior protective zone of the moldings should be free from support elements or spreaders which are easy to melt, as they constitute preferred current paths in case of unwanted arc displacements. As a result, the metal shaft may melt in spite of being almost completely covered.

A specific field of application of the materials used according to the invention are combination electrodes the metal shaft of which is internally cooled. The materials used in accordance with the invention are specifically geared to this purpose, as their preferred zone of thermal conductivity permits the optimum dissipation of heat observed on the protective elements.

The invention also comprises the moldings as such, e.g. protective rings, pipes, secotrs, or segments, which are made of the compound material proposed in this document. Therefore, the preceding description fully aplies also to such moldings as pipes, rings, or ring segments.

Figure 2:
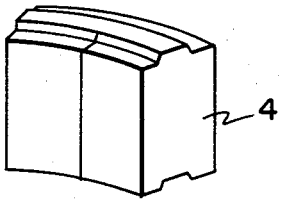
FIG. 2 is a perspective view of ring sectors for the cover ring of FIG. 1.
Figure 3:
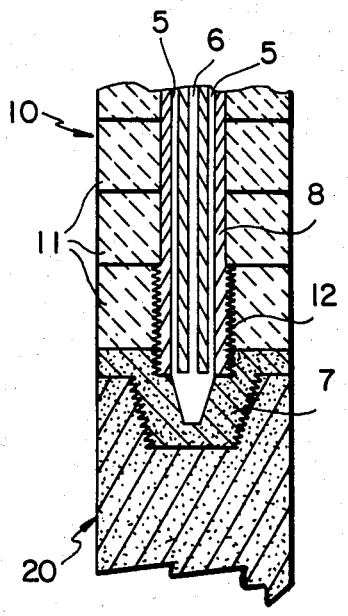
FIG. 3 is a side elevational view in cross-section through a portion only of an electrode showing an upper metal portion protected by cover rings.

FIG. 1 shows a cover ring 2 which has guideways 3 on the inside. By means of these guideways 3 the ring 2 can be placed on the metal shaft of the combination electrode, not shown. FIG. 2 illustrates the segment 4 or sector of protective ring 2. By joining several of these elements 4 it is possible to cover the total area of the metal shaft, not shown. These elements 4 may e.g. be attached to the electrode by an inside thread not shown in the drawing. FIG. 3 will be described in Example 1.

The invention has a number of surprising advantages. Under the conditions of arc furnace operations the protective coats are characterized by long service times and a surprisingly low suceptibility to oxidation. They show good mechanical properties, particularly a high pressure resistance. Due to the thermal conductivity of the compound materials the temperature of the metal shaft of the electrode can be kept within the desired range, which in general is below 500° C., without excessive pressure and excessive circulation speeds of the liquid coolant or without excessive heat dissipation from the furnace. Even when the combination electrode was operated for a long time, there was no problem of adhesive metal or adhesive slag, and the electrode could be inserted and removed through the opening of the electrode lid. Finally, as the protective coat is designed in the form of removable moldings, little maintenance and repair work will be required.

In the following the invention is described by examples which, however, should not be considered restrictive in any way:

EXAMPLE 1

Referring to FIG. 3, the upper 10 section of the electrode used consisted of a copper shaft 8, which was water-cooled by a system of supply 5 and return 6 ducts. The lower section 20 of graphite was connected to the copper shaft 8 by a threaded graphite nipple.

The part of the copper shaft 8 that was inserted into the electric arc furnace was completly covered by 3 rings 11 resting on each other, the lowest of which was screwed to the lower part of the copper shaft 8 by an inside thread 12.

3 electrodes each were inserted into a 50 t furnace, with solid scrap as furnace charge. The furnace was operated in 3 phases with a maximum phase current of 50 KA and a voltage of 490 V.

The compound material of the protective rings consisted of natural graphite from Sri Lanka (49 weight percent), natural clay (37 weight percent, composition: approx. 56% $SiO_2$, 33% $Al_2O_3$, 1.5% FeO, 0.9% CaO+MgO, 1.4% alkali, humidity—remaining percentage), SiC (6%) and silica sand (remaining percentage).

The original materials were ground in dry condition and mixed for hours in a chaser mill, with water being added for mixing purposes.

After this procedure the matterial was left untouched for one week at room temperature and then molded to the desired shape of a ring. Having been dried at a temperature of approx. 110° C. to 140° C., the rings were slowly burned in a muffle kiln at a temperature of approx. 1370° C.

After 150 charges of high-quality steel the rings made of this material still constituted a sufficient protection of the electrode the operation of which was free from disorders.

EXAMPLE 2

The compound material was produced in the analogous manner by homogenizing, molding, drying, and burning the following materials:

| | |
|---|---|
| bauxite | 40 weight per cent |
| hollow corundum | 11 weight per cent |
| melted $Al_2O_3$ | |
| tar coke | 22 weight per cent |

-continued

| | |
|---|---|
| Alabama graphite | 27 weight per cent |

EXAMPLE 3

| | |
|---|---|
| silicon carbide | 71 weight per cent |
| electrographite with approx. 70% graphitic structural elements | 25 weight per cent |
| carbon (from binding agent tar pitch) | remaining percentage |

EXAMPLE 4

| | |
|---|---|
| MgO (electrically melted) | 39 weight per cent |
| Alabama graphite | 20 weight per cent |
| anthracite | 31 weight per cent |
| magnesium oxide - magnesium chloride as binding agent | remaining percentage |

EXAMPLE 5

| | |
|---|---|
| aluminium siicate partly in the form of fibers ("Fiberfrax", trademark of The Carborundum Co., Niagara Falls, USA) | 36 weight per cent |
| premium petroleum coke | 57 weight per cent |
| phenol formaldehyde (phenolic resin) | 7 weight per cent |

The homogenized materials were suspended with water and vaccuum pressed. After a 2 hour drying period at a temperature of 170° C.–190° C. the material was burned at temperatures ranging between 500° C. and 600° C.

EXAMPLE 6

| | |
|---|---|
| $Al_2O_3$ | 39 weight per cent |
| $TiO_2$ | 28 weight per cent |
| kaolin | 3 weight per cent |
| magnesium silicate | 0.5 weight per cent |
| natural graphite | 11 weight per cent |
| petroleum coke from carbon (from binding agent tar pitch) | remaining percentage |

The protective rings the materials of which were composed as listed above and manufactured in an analogous manner, made it possible to operate the electrode without disorder, while long service times were obtained at the same time.

COMPARATIVE EXPERIMENT

The electrode employed corresponded to U.S. Pat. No 4,145,564. The protective rings used were of refractory clay with a low content of iron oxide (clay as described in Example 1).

However, several failures occurred during the operation of this electrode. Already after a few charges slag adhesion was such that a removal of the electrode through the opening of the electric arc furnace lid was no longer possible. In a further experiment, arc migration caused the metal shaft to melt via the metallic spreaders and suspension elements.

What is claimed is:

1. A protected combination electrode resistant to deleterious accumulations from liquid metal and slag, thereby adapted to be readily insertable and removable through a furnace lid opening, said combination comprising:

an upper electrode metallic shaft section;

a consumable carbon lower section attached by threaded engagement to said uppper metallic section; and removable, oxidation-resistant moldings of carbon embedded in a ceramic matrix, sintered at a temperature of less than about 1600° C. and removably mounted around said upper metallic section, the carbon of said moldings having graphitic structural elements, with the carbon portion being present in a proportion of between about twenty and eighty percent by weight and the ceramic matrix consisting essentially of fireclay, clay, kaolins, silicon dioxide, sillimanite, $Al_2O_3$, MgO, magnesium chloride, sintered dolomite, magnesium silicate, magnesium-chromium oxide ore, forsterite, bauxite, silicon carbide, silicon nitride, silica sand, zircon oxides, zircon mineral, titanium oxide, aluminum silicate, aluminum titanate containing silicate, spinels, kieselguhr, expanded fireclay, expanded clay, expanded vermiculite, expanded perlite, spherical corundum and mixtures thereof, with the ceramic portion being present in a proportion of between about twenty and eighty percent by weight.

2. The protected combination of claim 1, wherein the carbon portion of said removable moldings is present in an amount between 35 to 60 percent by weight, the ceramic portion 40 to 65 percent weight, while binders and impregnation agents are present in a proportion of from 0 to 15 percent by weight.

3. The protected combination of claim 1, wherein the carbon portion of said removable moldings comprises from 25 to 90 percent by weight of graphitic structural elements which consist essentially of natural graphite, electrographite, or mixtures thereof, with the non-graphitic portion being selected from the group consisting of anthracite, byproduct coke, carbon black, tar-pitch coke, petroleum coke and mixtures thereof.

4. The protected combination of claim 1 wherein the entire carbon portion of said removable moldings consists of graphite.

5. The protected combination of claim 1, wherein the carbon portion of said removable moldings is in predominantly anisotropic alignment.

6. The protected combination of claim 1, wherein the ceramic portion comprises an admixture containing boron oxide, highly refractory rare earth compounds or their mixtures.

7. A protected combination electrode resistant to deleterious accumulations from liquid metal and slag, thereby adapted to be readily insertable and removable through a furnace lid opening, said combination comprising:

an upper electrode metallic shaft section;

a consumable carbon lower section attached by threaded engagement to said upper metallic section; and removable, oxidation-resistant moldings of carbon embedded in a ceramic matrix, sintered at a temperature of less than about 1600° C. and removably mounted around said upper metallic section, the carbon of said moldings having graphitic structural elements, with a carbon balance, when present, selected from the group consisting of anthracite, carbon, coke and their mixtures, with the carbon portion being present in a proportion of between about twenty and eighty percent by weight and the ceramic portion consisting essentially of clay, SiC, silica sand, bauxite, corundum, $Al_2O_3$, MgO, magnesium chloride, aluminum silicate, $TiO_2$, kaolin, magnesium silicate and mixtures thereof, with the ceramic portion being present in a proportion of between about twenty and eighty percent by weight.

* * * * *